United States Patent [19]

Roof

[11] 4,076,460

[45] Feb. 28, 1978

[54] CONVERTIBLE LAWN CARE APPARATUS

[76] Inventor: Earl O. Roof, 1228 N. Walnut St., Pontiac, Ill. 61764

[21] Appl. No.: 706,441

[22] Filed: Jul. 19, 1976

Related U.S. Application Data

[63] Continuation of Ser. No. 310,985, Nov. 30, 1972, abandoned.

[51] Int. Cl.[2] ..... F04B 41/00; B02C 19/12; F01D 25/00

[52] U.S. Cl. ..... 417/236; 417/238; 241/101.1; 415/121 R; 415/127

[58] Field of Search ..... 417/231, 234, 236, 238; 415/146, 148, 152 A, 184; 15/328, 350, 351; 56/2, 16.9, 501, 13.2; 302/36, 1, 38; 241/101, 101.1

[56] References Cited

U.S. PATENT DOCUMENTS

| | | | |
|---|---|---|---|
| 694,588 | 3/1902 | Tyler | 415/148 |
| 1,297,191 | 3/1919 | Lepley | 415/148 |
| 1,697,918 | 1/1929 | Keefer | 15/328 |
| 2,646,934 | 7/1953 | Sandor | 241/101 R |
| 2,675,660 | 4/1954 | Barnard | 56/16.9 |
| 3,241,173 | 3/1966 | Finn | 302/37 |
| 3,618,157 | 11/1971 | Bassin | 15/330 |
| 3,688,479 | 9/1972 | Martinson | 56/13.2 |
| 3,968,938 | 7/1976 | Ruhl | 241/101.1 |

FOREIGN PATENT DOCUMENTS

| | | | |
|---|---|---|---|
| 453,726 | 12/1927 | Germany | 415/127 |
| 583,557 | 12/1946 | United Kingdom | 415/184 |

*Primary Examiner*—William L. Freeh
*Attorney, Agent, or Firm*—Robert E. Browne

[57] ABSTRACT

Portable lawn care apparatus is disclosed which includes attachment assemblies for converting to a mobile vacuum, a shredder/chipper, a blower or a stationary vacuum with a hand-operated flexible hose.

9 Claims, 11 Drawing Figures

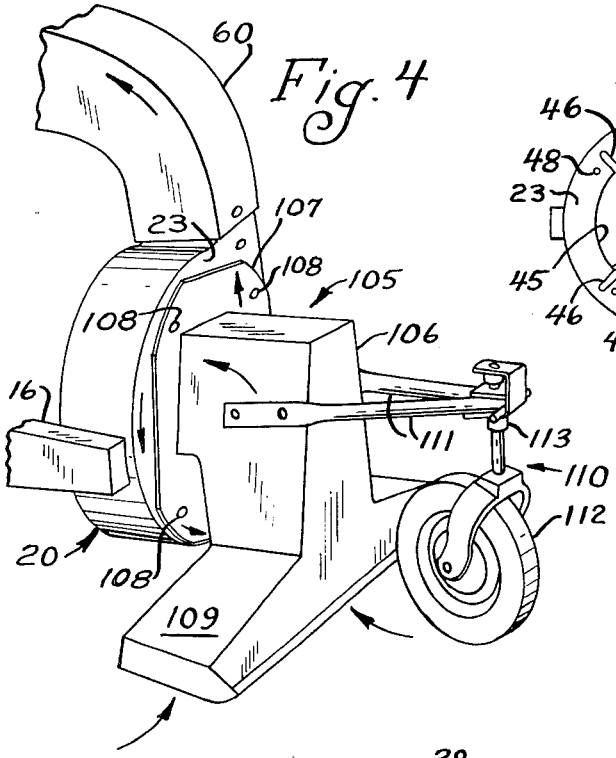
Fig. 4
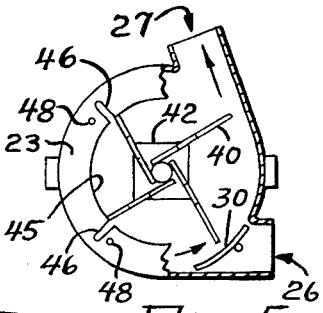
Fig. 5
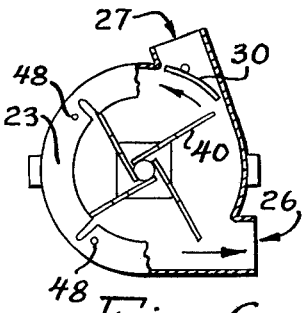
Fig. 6
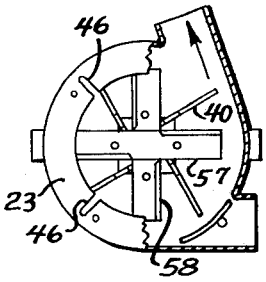
Fig. 9
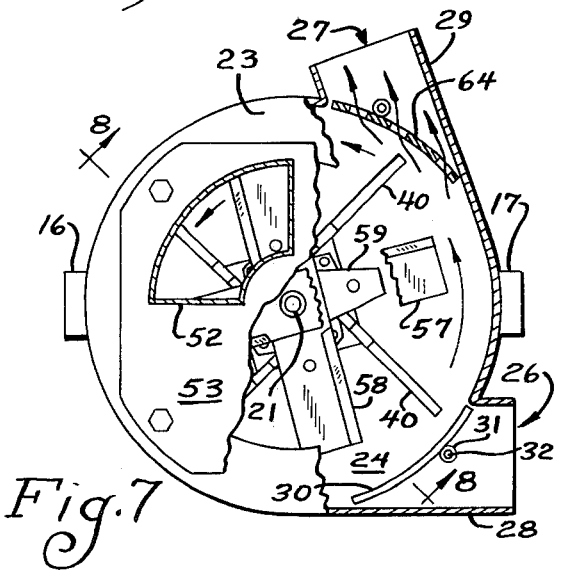
Fig. 7
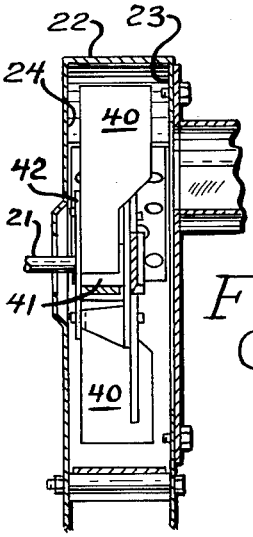
Fig. 8
Fig. 10
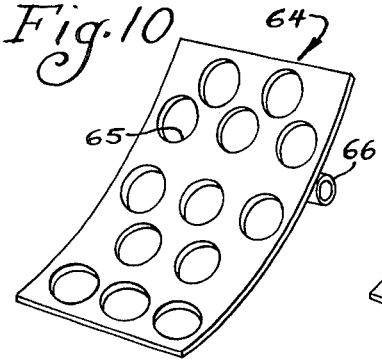
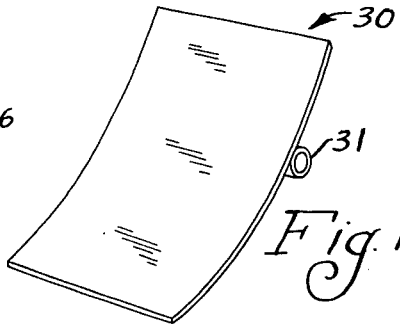
Fig. 11

CONVERTIBLE LAWN CARE APPARATUS

This is a continuation, of application Ser. No. 310,985, filed Nov. 30, 1972, now abandoned.

BACKGROUND AND SUMMARY

The present invention relates to lawn care apparatus; and more particularly, it relates to portable lawn care apparatus which is convertible to machines performing different lawn care functions.

The increased amounts of waste together with restraints that are being imposed on the way in which such debris can be disposed of (in particular, the air pollution laws prohibiting open burning) the collection and disposal of debris has become a problem. Such debris not only includes leaves, grass clippings, hedge trimmings, fallen branches and the like, but it also includes paper, boxes, wrappings, etc.

The present invention provides a portable lawn care apparatus which includes attachment assemblies for converting it either to a mobile vacuum, a shredder/-chipper, a blower or a stationary vacuum with flexible hose.

The apparatus includes a gasoline engine mounted on a chassis provided with two side wheels, and it includes a push handle in the form of an inverted U. An impeller housing is mounted to the wheel axle and in front of the engine. It includes a cylindrical side wall and front and rear walls. The front wall has a large central opening. The drive shaft of the engine extends coaxially inside of the side wall of the impeller housing. An impeller assembly is mounted on the drive shaft inside the housing. The side wall of the housing includes two separate discharge openings; and a blocking plate is selectively positionable in one or the other of these discharge openings to block it, depending upon the intended use of the apparatus.

Preferably, one of the discharge openings or outlets on the impeller housing projects laterally near the bottom of the housing and the other projects upwardly from the top of the housing. When used as a shredder/-chipper, a mobile vacuum or a stationary vacuum, the blocking plate is attached to cover the lower discharge opening; and when used as a blower, the blocking plate is inserted to cover the upper discharge opening.

As a mobile vacuum, it can be moved either by hand or it can be drawn behind a small tractor for cleaning an area of grass clipping, leaves and other debris.

The vacuum attachment assembly includes a nose cone having an intake aperture parallel to and adjacent the ground, and which mounts to the front side of the impeller housing. A front caster wheel assembly is adjustably mounted to the nose cone for adjusting the height of the intake opening. An exhaust elbow is connected to the impeller housing to direct material exiting through the upper discharge outlet into a dust bag located rearwardly of the engine and between the arms of the inverted U-shaped push handle.

The shredder/chipper attachment assembly includes an inlet hopper into which the material to be shredded is fed, and which is mounted to the forward wall of the housing. Knives are secured to the impeller blade for chopping and shredding the material which is then exhausted through the upper discharge opening and conveyed by means of the exhaust elbow into a collection bag. An apertured mulch plate may be placed in the upper discharge outlet for this application so that only material of a predetermined small size passes to the collection bag. Such a plate is particularly useful if it is desired to compost the material.

For use as a blower, a blower attachment assembly is secured to the front of the impeller housing, and it includes a baffle plate spaced forwardly of the housing to permit the intake of air. The baffle plate is provided with a caster front so that the apparatus is stabilized in use, and for this application, the blocking plate is attached to cover the upper discharge outlet. A blower nozzle is then secured adjacent the impeller housing adjacent the lower discharge outlet to direct air either forwardly or sideways of the apparatus which is easily pushed by an operator or drawn by a vehicle.

A vacuum hand hose attachment assembly includes a front cover plate secured to the forward end of the impeller housing and provided with a sleeve to which a long flexible hose is mounted. A pick-up nozzle and handle are secured to the forward end of the hose which is moved about by hand; and a pedestal is secured to the cover plate so that the device can rest on three supports, including the two wheels. For this application, the blocking plate is secured to cover the lower discharge outlet; and again, the exhaust elbow is attached to the impeller housing to route debris collected into the collection bag.

Other features and advantages of the present invention will be apparent to persons skilled in the art from the following detailed description of the preferred embodiment accompanied by the attached drawing wherein identical reference numerals will refer to like parts in their various views.

THE DRAWING

FIG. 4 is a fragmentary view similar to FIG. 1, but at a lower angle, with the apparatus modified as a mobile vacuum;

FIGS. 5 and 6 illustrate the alternate locations for the blocking plate;

FIG. 7 is a partially broken away frontal view of the impeller housing with the apparatus modified as a chipper/shredder and including a mulch plate;

FIG. 8 is a cross sectional view taken through the sight lines 8-8 of FIG. 7;

FIG. 9 is a view similar to FIG. 5 but showing the shredder knives; and

FIGS. 10 and 11 are perspective views respectively of a mulch plate and the blocking plate.

DETAILED DESCRIPTION

In general, the present invention includes a wheel-mounted power unit which may be converted to a shredder/chipper (FIG. 1), a vacuum with a hand hose (FIG. 2), a blower (FIG. 3), or a mobile vacuum (FIG. 4). The conversion is accomplished by mounting the appropriate attachment assembly, as will be discussed in greater detail below, to the wheel-mounted power unit.

Power Unit

Figure 1:
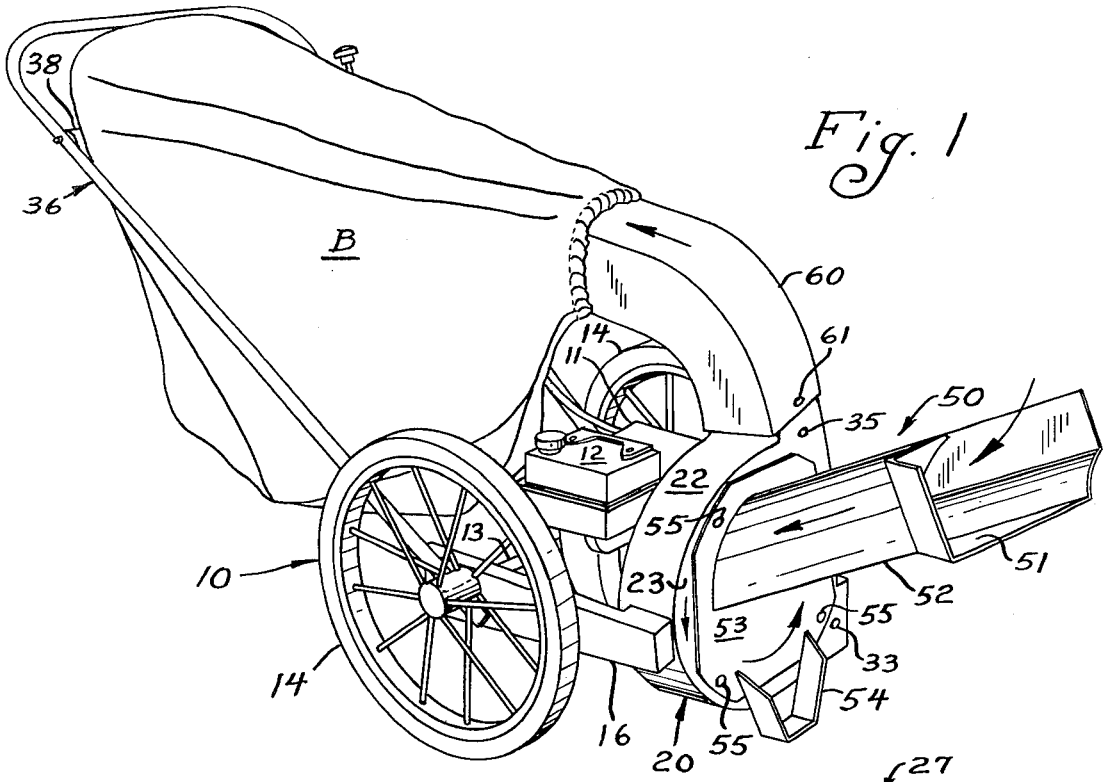
FIG. 1 is an upper perspective view taken from the forward left side of apparatus incorporating the present invention and including a shredder assembly.

Turning then to FIG. 1, reference numeral 10 generally designates a power unit which includes a conventional gasoline reciprocating engine 11, the gas storage tank being designated 12. The engine 11 is mounted on a chassis which includes an axle 13 to the sides of which are rotatably mounted wheels 14. The wheels 14, as can be seen, are of the spoke type so as to permit the larger diameter—preferably of the order of about 20 in.

First and second side frame arms 16 (FIG. 1) and 17 (FIG. 2) are rigidly secured at their rear portions to the axle 13 and at their forward ends to an impeller housing generally designated 20. Thus, the impeller housing 20 is mounted directly in front of the engine 11, and the shaft of the engine 11 (designated by reference numeral 21 in FIG. 7) extends into the housing 20.

The impeller housing 20 has the general form of a drum with its axis extending along the direction of travel of the apparatus. The housing includes a cylindrical side wall 22, a front end plate 23, and a rear end plate 24 (FIG. 7). The front plate 23 has a large central opening, as will be further explained.

First and second discharge openings generally designated respectively 26 and 27 are formed in the cylindrical side wall 22. The discharge outlet 26 includes a generally rectangular spout 28 which extends in a horizontal direction from the lower part of the impeller housing 20—that is, it extends in a generally tangential direction away from the bottom of the housing, and its primary use, as will be discussed in more detail below, occurs when the apparatus is set up as a blower, as in FIG. 3. The upper discharge outlet 27 includes a similar peripheral spout 29 which extends in an upward direction, generally tangential to the side wall at the 2 o'-clock position, as seen in FIG. 7.

A blocking plate, generally designated 30, and seen best in FIG. 11, is curved to conform to the shape of the side wall 22 of the impeller housing 20, and it is adapted to close either the lower discharge outlet 26 (when inserted in the position shown in FIG. 5) or the upper discharge outlet 27 (when inserted as shown in the position of FIG. 6). A sleeve or tube 31 is welded to the back of the blocking plate 30, offset to one end thereof toward the downstream direction of air flow within the impeller housing (i.e., counterclockwise as viewed in FIG. 7). The blocking plate is held in place by means of a pin 32 which is received in the sleeve 31 and extends through apertures 33 in the spout 28 when it is desired to block the lower discharge opening 26 or alternatively, in the apertures 35 in the spout 29 when it is desired to block the upper discharge opening 27. The pin may have a head at one end and be held in place by a cotter pin at the other.

A push handle having the shape of an inverted U and designated 36 in FIG. 1 is secured at its lower ends to the rear portions of the frame members 16, 17 so as to permit an operator to lift the power unit and any attachment assemblies, if desired, or to push the unit. A cross bar 38 is used to support the rear portion of a collection bag designated B, if desired.

An impeller assembly having four paddle-shaped blades 40 is driven by the shaft 21 in a counterclockwise direction as indicated by the arrows in FIG. 7. Turning now to FIG. 8, each of the impeller blades 40 can be seen to extend in planes generally parallel to the axis of the shaft 21, and they are welded to a journal member 41 which is rotatably mounted on a plate 42 which is secured to the rear wall 24 of the impeller housing for securing the impeller assembly within the housing 20.

As seen best in FIGS. 5-9, the front wall 23 of the impeller housing 20 has a large central opening, as indicated at 45, thus leaving the shape of the front wall 23 to be annular. Four radially extending slots 46 are formed in this annular front wall 23 to facilitate installation and removal of the impeller assembly, the slots 46 being located and sized so as to receive the blades 40. Four apertures 48 are also located in the annular front wall 23 for receiving mounting bolts, as will be discussed presently.

Shredder/Chipper Attachment Assembly

Referring to FIG. 1, the shredder/chipper attachment assembly includes a one-piece inlet unit generally designated 50 comprising an inlet mouth or hopper 51, a feed tube 52 communicating with the base of the hopper 51, a cover plate 53 supporting the tube 52, and a foot 54 welded to the face of the cover plate 53. The cover plate 53 is secured to the peripheral face plate 23 of the impeller housing 20 by means of bolts 55 which are received in the threaded apertures 48. The feed tube 52 is formed in the general shape of a quarter of an annulus so as to feed the material desired to be shredded at a location away from the center of the impeller (see FIG. 7).

Figure 3:
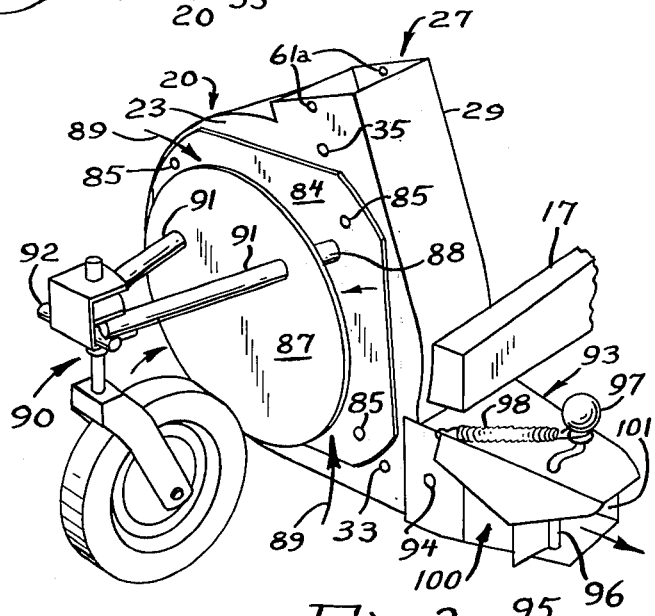
FIG. 3 is a fragmentary upper perspective view from the left front side with the apparatus modified as a blower.

Referring now to FIGS. 7 and 9, first and second chipper knives 57 and 58 are mounted to a chipper knife adaptor 59 which is shaped in the form of a cross and mounted to the impeller assembly to rotate therewith. As best seen in FIG. 9, the shredder knives 57 and 58 are located in a forward position in the impeller housing and they lie in a plane which is perpendicular to the planes in which the impeller blades 40 extend. Further, the chipper knives 57, 58 are located between the impeller blades 40. As has already been mentioned, the cross sectional shape of the feed tube 52 is annular, and it is located in the upper left-hand quarter of the impeller housing; whereas the discharge opening 27 is located in the upper right-hand quarter. For this application, the blocking plate 30 is secured to cover the lower discharge outlet 26, and the resulting shredded material is passed through the upper discharge outlet 27 and into the bag B by means of a rearwardly curved elbow 60 which is secured to the spout 29 by screws 61 received in apertures **61*a* (FIG. 3). The discharge elbow 60 is square in cross section as is the spout 29 on the impeller housing so that the screws 61** may be removed and the elbow turned to either side if it is desired to deposit the composted material directly onto a pile. It will be observed that the material being shredded must travel at least three-quarters of the way around the impeller housing prior to being exhausted.

If it is desired to shred the material into smaller pieces, a mulch plate 64 may be located in the upper discharge outlet 27. As best seen in FIG. 10, the mulch plate 64 includes a plurality of apertures 64, and a rear tubular sleeve 66 for mounting in a manner similar to that already described in connection with the blocking plate 30. If the material being shredded is organic, it is more easily composted with the use of the mulch plate 64.

The shredder/chipper attachment assembly may be used to shred any organic or waste material desired, including trimmings from trees and shrubbery, leaves, and the like.

A disposable apertured plastic liner bag may be included inside of the collection bag B for disposing of the resulting shredded material or the material, as mentioned, may be dumped onto a compost pile.

Hand-Hose Vacuum Attachment

Figure 2:
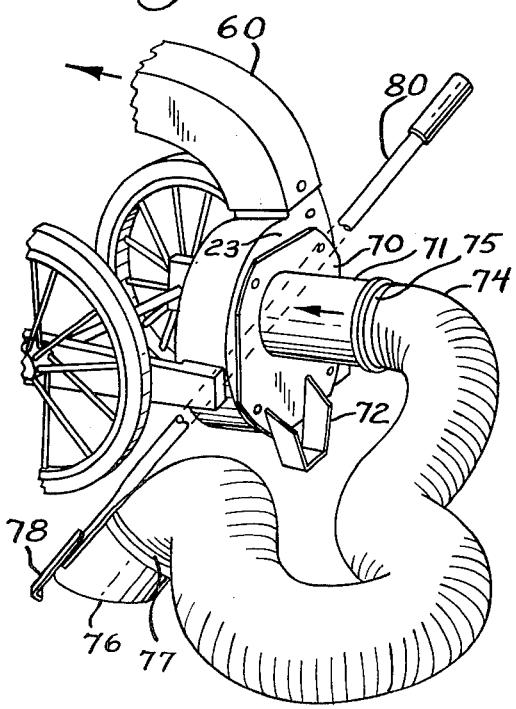
FIG. 2 is a fragmentary view similar to FIG. 1 with the device modified for use as a hand vacuum.

The hand-hose vacuum attachment is seen in FIG. 2. It includes a cover plate 70 which is provided with an inlet conduit 71 and a foot 72. The cover plate 70 is secured to the peripheral front plate 23 of the impeller housing 20 in a manner similar to that described in connection with the cover plate 53 of FIG. 1.

A flexible hose 74 is clamped to the conduit 71 by means of a hose clamp 75, at one end, and to a metal tubular nose section 76 at its other end by means of a clamp 77. A spacer member 78 is secured to the nose section 76 to space it from the ground. An elongated handle 80 is also attached to the nose section 76 for moving it as desired. It will be observed that the inlet conduit 71 is, again, offset in the upper left-hand quarter of the impeller housing.

For use with the hand vacuum hose attachment assembly, the knives 57, 58 are not used, and the blocking plate is again located to cover the lower discharge outlet 26. The material collected is fed through the exhaust elbow 60 through the upper discharge outlet 27 and into the collection bag B which may again be provided with a plastic liner, if desired.

The hand hose attachment assembly may be used primarily to pick up leaves, particularly after they have been piled or windrowed. The mulch plate 64 may be used to further reduce the resulting volume of material. This attachment assembly has been found to be an excellent tool for clearing leaves from beneath shrubbery, off porches and patios, and from other hard-to-reach places. The shredder knives 57, 58, may be used if the material being collected is desired to be mulched.

Blower Attachment Assembly

Referring now to FIG. 3, the blower attachment assembly includes a face plate 84 which is provided with a central aperture (not shown) for admitting inlet air into the impeller housing 20; and it is mounted to the face plate 23 of the impeller housing by bolts 85 received in the apertures 48. A circular guard or baffle plate 87 is secured to the face plate 84 and spaced therefrom by means of spacers 88 so that inlet air enters the impeller housing in the direction of the arrows 89 in the annular opening between the face plate 84 and baffle plate 87. A caster wheel assembly generally designated by reference numeral 90 is secured to the guard plate 87 by means of rods 91. The height of the front caster wheel is adjustable, and a cross bar 92 is provided for attachment to a tractor hitch if it is desired to pull the unit to windrow leaves, for example.

When used as a blower, the blocking plate 30 is attached to block the upper discharge opening 27 (FIG. 6), and a discharge baffle assembly generally designated 93 is attached to the spout 27 by screws 94 threaded into the apertures 33 of that spout to direct air either sideways or forwardly. A rotatable baffle plate 95 is attached to a shaft 96 provided with a handle 97. The shaft 96 is journaled in the upper and lower walls of the baffle assembly 93, and it is biased in a forward position shown by means of a spring 98. If the handle 97 is turned a half turn to the right of FIG. 3, it is held in an over-center position and the baffle plate 95 covers the forward opening 100 so that the air is directed sideways through the side opening 101.

The blower attachment assembly is used primarily for blowing leaves into a pile or windrowing leaves or grass clippings off of driveways, sidewalks, etc.

Vacuum Attachment Assembly

As seen in FIG. 4, the vacuum attachment assembly is generally designated by reference numeral 105, and it includes a vacuum nose cone 106 secured to a mounting plate 107 which is attached to the face plate 23 of the impeller housing 20 by means of screws 108. The screws 108 are threaded into the previously described holes 48. The lower portion of the nose cone 106 is flared outwardly to provide a vacuum intake housing 109.

A front caster wheel assembly 110 is secured by means of braces 111 to the nose cone 106.

The height of the front caster wheel assembly is, again, adjustable, and it is provided with a transverse rod 113 so that the unit may be pulled by a tractor provided with a hitch.

When used as a mobile vacuum, the blocking plate 30 is located to cover the lower discharge outlet 26, and the knives 57, 58 are not used. The material thus picked up is forced to the upper discharge outlet 27, through the exhaust elbow 60, and into the collection bag B which, again, may be provided with a disposable plastic liner is desired.

The mobile vacuum attachment, whether drawn by a tractor or pushed by means of the handle 36 is useful for vacuuming up grass clippings, leaves, and for cleaning sidewalks, driveways, etc. The mulch plate 64 may be installed in the upper discharge position to reduce the volume of leaves, if desired. For this application, the collection bag B may be a dust bag to eliminate dust clouds.

Having thus described in detail a preferred embodiment of the present invention, persons skilled in the art will be able to modify certain of the structure which has been illustrated and to substitute equivalent elements for those disclosed while continuing to practice the principle of the invention; and it is, therefore, intended that all such modifications and substitutions be covered as they ae embraced within the spirit and scope of the appended claims.

I claim:

1. A portable, multi-purpose lawn care apparatus for preparing and maintaining lawn areas, which is selectively convertible from a vacuum mode of operation to a blower mode of operation, including:

a chassis mounted on a pair of side wheels;

a drive motor mounted on said chassis;

an upright impeller housing fixedly mounted on said chassis, said impeller housing having a generally cylindrical side wall, a back wall and a front wall, said front wall having a central opening formed therein, an upper discharge opening and a lower discharge opening being formed in said side wall of said impeller housing;

an impeller assembly disposed in said impeller housing, said impeller assembly having a drive shaft operatively connected to said drive motor and rotatable thereby about a central axis of said drive shaft and a plurality of outwardly-extending impeller blades mounted on said drive shaft for rotation therewith about said central axis thereof;

blocking means for selective positioning within said impeller housing, said blcoking means being movable between a first operating position, and a second operating position, to convert said lawn care apparatus from said vacuum mode of operation to said blower mode of operation, said blocking means being removably mounted, in said first operating position, over said lower discharge opening such that air is drawn through said central opening in said front wall of said impeller housing and directed towards said upper discharge opening;

said blocking means being removably mounted, in said second operating position, over said upper discharge opening such that air is drawn through said central opening in said front wall of said impeller housing and directed towards said lower discharge opening; and, operating means removably mounted on said impeller housing over said central opening formed in said front wall thereof.

2. The lawn care apparatus of claim 1 wherein said blocking means includes a generally elongated blocking plate having a radius of curvature substantially similar to that of said cylindrical side wall of said impeller housing, and having an over-all area sufficient to substantially obstruct either discharge opening over which it is positioned, said blocking plate having a transverse mounting means attached to one side thereof, whereby said blocking plate may be positioned between said front wall and said back wall of said impeller housing, said transverse mounting means being offset toward one end of said blocking plate such that said blocking plate is always maintained in position within said impeller housing blocking one of said selected upper or lower discharge openings by the force of air moved within the impeller housing.

3. The lawn care apparatus of claim 1 wherein said blocking means is selectively positioned over said lower discharge opening in said first position for use in connection with an operating means including a stationary vacuum attachment having a third cover plate mounted on said front wall of said impeller housing, for optionally and releasably attaching said stationary vacuum attachment, an intake tube attached to said cover plate for communicating material therethrough into said impeller housing through an opening formed in said third cover plate, a flexible hose having a handle-equipped nose portion connected to said intake tube for vacuuming said material into said impeller housing and a discharge chute mounted over said upper discharge opening of said impeller housing.

4. The lawn care apparatus of claim 1 wherein said blocking means is selectively positioned in said first position over said lower discharge opening for use in connection with an operating means including a mobile vacuum attachment having a fourth cover plate mounted over said central opening in said front wall of said impeller housing for optionally and releasably attaching said mobile vacuum attachment to said impeller housing, said fourth cover plate having an inlet opening, a nose cone assembly attached to said fourth cover plate over said inlet opening, said nose cone assembly having at its lower portion an intake vacuum housing, and a caster wheel secured to said nose cone assembly and extending in front of said assembly to partially support the weight of said impeller housing and said mobile vacuum attachment.

5. The lawn care apparatus of claim 1 wherein a perforated mulch plate may be disposed over said upper discharge opening when said blocking means is disposed over said lower discharge opening, said mulch plate having a radius similar to said side wall of said impeller housing and acting to reduce the size of material drawn into said impeller housing.

6. The lawn care apparatus of claim 1 wherein said operating means includes a chipper/shredder attachment, said chipper/shredder attachment having a first cover plate mountable over said central opening in said front wall of said impeller housing for optionally and releasably attaching said chipper/shredder attachment to said impeller housing, hopper means fixedly mounted on said cover plate for directing material to be shredded into said impeller housing and shredding knife means mounted on said impeller assembly and rotatable in conjunction with said impeller blades to shred material received into said impeller housing.

7. The lawn care apparatus of claim 6 wherein said chipper/shredder attachment which is mounted on said impeller housing when said blocking plate is in said first position includes a collection bag in communication with said upper discharge opening to receive material from said upper discharge opening, and said shredding knife means includes a cross-shaped adapter plate mounted on an outward end of said drive shaft for rotation therewith, and a plurality of shredding knives attached to said adapter plate extending in a plane perpendicular to said central axis of said drive shaft, said shredding knives being mounted between said impeller blades and said hopper to shred material directed into said impeller housing.

8. The lawn care apparatus of claim 1 wherein said operating means includes a blower attachment having a second cover plate mounted over said central opening in said front wall of said impeller housing for optionally and releasably attaching said blower attachment to said impeller housing, said second cover plate having an air inlet opening formed therein and a baffle plate mounted outwardly of said second cover plate in spaced relationship thereto and over said air inlet opening formed therein to provide a protected air intake.

9. The lawn care apparatus of claim 8 wherein said blower attachment for use in connection with said impeller housing when said blocking plate is in said second selected position includes an outlet baffle mounted over said lower discharge opening of said impeller housing for routing air from said impeller housing toward the lawn, and a forward caster wheel assembly mounted to said baffle plate and supporting a portion of said impeller housing, said caster wheel assembly being vertically adjustable relative to the surface of the lawn.

* * * * *